US006610154B2

(12) United States Patent
Limoges et al.

(10) Patent No.: US 6,610,154 B2
(45) **Date of Patent: *Aug. 26, 2003**

(54) SURFACE TREATMENT OF AUSTENITIC NI-FE-CR BASED ALLOYS FOR IMPROVED RESISTANCE TO INTERGRANULAR CORROSION AND INTERGRANULAR CRACKING

(75) Inventors: David L. Limoges, Etobicoke (CA); Gino Palumbo, Etobicoke (CA); Peter K. Lin, Toronto (CA)

(73) Assignee: Integran Technologies Inc., Toronto (CA)

( * ) Notice: Subject to any disclaimer, the term of this patent is extended or adjusted under 35 U.S.C. 154(b) by 9 days.

This patent is subject to a terminal disclaimer.

(21) Appl. No.: 09/993,905

(22) Filed: Nov. 27, 2001

(65) Prior Publication Data

US 2002/0084008 A1 Jul. 4, 2002

Related U.S. Application Data

(63) Continuation-in-part of application No. 09/579,527, filed on May 26, 2000, now Pat. No. 6,344,097.

(51) Int. Cl.[7] ..... C21D 1/09

(52) U.S. Cl. ..... 148/525; 148/529; 148/592; 148/593; 148/676; 148/677

(58) Field of Search ..... 148/516, 525, 148/529, 592, 593, 676, 677

(56) References Cited

U.S. PATENT DOCUMENTS

| | | | | |
|---|---|---|---|---|
| 3,844,846 A | | 10/1974 | Friske et al. | |
| 4,086,104 A | | 4/1978 | Kinoshita et al. | |
| 4,424,083 A | | 1/1984 | Polizotti et al. | |
| 4,481,802 A | | 11/1984 | Harman et al. | |
| 4,495,002 A | | 1/1985 | Anello | |
| 4,816,217 A | * | 3/1989 | Bassford et al. | 148/442 |
| 5,625,664 A | * | 4/1997 | Berkley | 378/72 |
| 5,702,543 A | | 12/1997 | Palumbo | |
| 5,816,088 A | | 10/1998 | Yamada et al. | |
| 5,817,193 A | | 10/1998 | Palumbo | |
| 5,932,120 A | | 8/1999 | Mannava et al. | |
| 6,344,097 B1 | * | 2/2002 | Limoges et al. | 148/592 |

FOREIGN PATENT DOCUMENTS

| | | | |
|---|---|---|---|
| EP | 0 933 438 A1 | | 8/1999 |
| JP | 61-229481 A | * | 10/1986 |
| WO | 01/90433 A2 | | 11/2001 |

OTHER PUBLICATIONS

Secondary Recrystallization in Copper; Kronberg and Wilson, Trans. Met. Soc. AIME, 185, 501 (1949).
The Structure of High–Angle Grain Boundaries; Brandon, Acta Metall.; 14, 1479, (1966).
JP 59 107068 (Hitachi Seisakusho KK) Jun. 21, 1984.
JP 59 013057 A (Tokyo Shibaura Denki KK) Jan. 23, 1984.

* cited by examiner

*Primary Examiner*—George Wyszomierski
(74) *Attorney, Agent, or Firm*—Ridout & Maybee LLP; Randall S. Mitchell

(57) ABSTRACT

A surface treatment process for enhancing the resistance to intergranular corrosion and intergranular cracking of components fabricated from austenitic Ni—Fe—Cr based alloys comprising the application of surface deformation to the component, to a depth in the range of 0.01 mm to 0.5 mm, for example by high intensity shot peening below the recrystallization temperature, followed by recrystallization heat treatment, preferably at solutionizing temperatures. The surface deformation and annealing process can be repeated to further optimize the microstructure of the near-surface region. Following the final heat treatment, the process optionally comprises the application of further surface deformation (work) of reduced intensity, yielding a worked depth of between 0.005 mm to 0.01 mm, to impart residual compression in the near surface region to further enhance cracking resistance.

19 Claims, 3 Drawing Sheets

SURFACE TREATMENT OF AUSTENITIC NI-FE-CR BASED ALLOYS FOR IMPROVED RESISTANCE TO INTERGRANULAR CORROSION AND INTERGRANULAR CRACKING

RELATED APPLICATION

This application is a continuation-in-part of application Ser. No. 09/579,527 filed on May 26, 2000 and now U.S. Pat. No. 6,344,097 entitled SURFACE TREATMENT OF AUSTENITIC Ni—Fe—Cr BASED ALLOYS FOR IMPROVED RESISTANCE TO INTERGRANULAR -CORROSION AND -CRACKING.

FIELD OF THE INVENTION

This invention relates to a process for the surface treatment of articles fabricated of austenitic iron-nickel-chromium alloys, to resist and deter the onset of intergranular cracking and corrosion and to enhance the concentration of special grain boundaries. The process comprises at least one cycle of working to induce deformation of the near surface region, for example by high density shot peening, followed by recrystallization heat treatment. The novel process can be applied to wrought, cast or welded materials, and is particularly suited for in-situ or field application to components such as steam generator tubes, core reactor head penetrations of nuclear power plants, recovery boiler panels used in the pulp and paper industry, closure welds on canisters for the storage of nuclear waste and storage battery components.

DESCRIPTION OF PRIOR ART

The prior art primarily describes the use of surface cold work, for example by "shot peening", as a means to effect a state of residual compression at the surface of a material, and thus render the material resistant to the initiation of cracks which require a tensile stress for initiation and propagation. Shot peening is a method of cold working, inducing compressive stresses on and near the surface layer of metallic parts. The process consists of impinging the test article with a stream of shot, directed at the metal surface at high velocity under controlled conditions.

Although peening cleans the surface the major purpose is to impact and enhance fatigue strength. The peening process is known to relieve tensile stresses that contribute to stress-corrosion cracking. Yamada in U.S. Pat. No. 5,816,088 (1998) describes a surface treatment method for a steel work piece using high speed shot peening. Mannava in U.S. Pat. No. 5,932,120 (1999) describes a laser shock peening apparatus using a low energy laser. Harman and Lambert in U.S. Pat. No. 4,481,802 (1984) describe a method of peening the inside of a small diameter tube in order to relieve residual tensile stresses.

Friske and Page in U.S. Pat. No. 3,844,846 (1974) describe a surface deformation treatment by shot peening, which is applied to austenitic Cr—Fe—Ni alloys without subsequent heat treatment, in order to render the surface region highly deformed, and subsequently more resistant to intergranular corrosion in the event that the article becomes exposed to sensitization temperatures, i.e., 400°–700° C., during service.

Kinoshita and Masamune in U.S. Pat. No. 4,086,104 (1978) also describe a surface deformation treatment for austenitic stainless steel components, applied following final mill annealing or hot rolling treatments, which renders the surface of the stainless steel more resistant to oxide scale formation during subsequent exposure to high temperature steam.

Anello in U.S. Pat. No. 4,495,002 (1985) describes a three step process for martensitic stainless steels to increase their resistance to chloride corrosion, wherein, an article is subjected to surface deformation via shot peening, followed by an ageing treatment at 527° C.–549° C., and followed by a final lower intensity shot peening. In such manner, a homogeneous near surface region consisting of aged martensite is obtained which is resistant to chloride corrosion and cracking.

Polizotti in U.S. Pat. No. 4,424,083 (1984) discloses a method for enhancing the protection of cast austenitic stainless steel tube against carburization when such tubes are employed in high temperatures carburizing atmospheres, such as in the steam cracking of hydrocarbons. The diffusion of carbon into the alloy steel causing formation of additional carbides, resulting in embrittlement of the tubes, is avoided by heating the cold-worked inner surfaces of such a tube for an effective amount of time, at a temperature between the recrystallization temperature and its melting temperature, in an atmosphere where the oxygen partial pressure is at least oxidizing with respect to chromium. These temperatures used by Polizotti are stated to be 420°–1150° C., preferably 420°–800° C. with the treatment time at such temperatures being about 200 to about 500 hours. Suitable atmospheres include hydrogen or steam. The treatment time required depends on the oxygen partial pressure, longer treatment times are required if the oxygen partial pressure is low.

Palumbo in U.S. Pat. Nos. 5,702,543 (1997) and 5,817,193 (1998), describes thermomechanical mill processes involving the application of bulk cold work followed by recrystallization heat treatment to improve the grain boundary microstructure of austenitic Ni—Fe—Cr alloys and thereby effect significant improvements in intergranular corrosion and cracking resistance.

Studies have shown that certain "special" grain boundaries, described on the basis of the "Coincident Site Lattice" model of interface structure (Kronberg and Wilson, Trans. Met. Soc. AIME, 185, 501 (1949)) as lying within $\Delta\theta$ of $\Sigma$, where $\Sigma \leqq 29$ and $\Delta\theta \leqq 15° _ \Sigma^{-0.5}$ (Brandon, Acta Metall., 14, 1479, (1966)) are highly resistant to intergranular degradation processes such as corrosion, cracking, and grain boundary sliding; the latter being a principal contributor to creep deformation. The disclosure of Kronberg and Wilson and of Brandon are incorporated therein by reference to their teachings covering special grain boundaries.

We have discovered that finished and semi-finished articles made of austenitic Ni—Fe—Cr alloys, whether in the wrought, forged, cast or welded condition, may be subjected to working to induce deformation of the near surface region by a technique such as shot peening, followed by annealing of the article at a temperature below the melting point for a time sufficient to induce recrystallization in the cold-worked near surface region and increase the frequency of special low $\Sigma$ CSL grain boundaries.

In this specification, "the near surface region" refers to the surface layer of the article to a depth in the range of 0.01 mm to about 0.5 mm. "Working" will hereinafter be used in this specification as a shorthand reference to working to induce deformation.

SUMMARY OF THE INVENTION

It is a principal object of this invention to provide a surface treatment methodology which will alter the recrystallized structure in the near surface region of a finished article or component made austenitic Ni—Fe—Cr alloys to impact significant resistance to intergranular corrosion and cracking during the service of the article or component, without the need for bulk deformation thereof by a process of rolling, extruding, forging or the like. The hardness of the surface layer after the recrystallization treatment is lower than the hardness of the article before the processing.

It is a further object of this invention to provide a surface treatment process as aforesaid, which may be used to treat and improve the degradation and corrosion resistance of finished parts of complex shape and parts which may already be in service, in particular, nuclear steam generator tubes, nuclear reactor head penetrations and the like. Suitably treated parts also include weld clad components such as recovery boiler wall panels for the pulp and paper industry, and closure welds on canisters for nuclear waste storage.

The method of the present invention enhances the concentration of special grain boundaries in the surface of metallic articles. This is achieved without invoking conventional strengthening mechanisms, such as precipitation or age-hardening, and without substantially altering the tensile strength or hardness of the material. Typically the layer in which the special grain boundary fraction has been increased, exhibits a reduction in tensile strength, when compared to the as received material or the bulk of the material, which has not been subjected to this process.

Our experiments and reviews of the literature indicate that conventional surface cold working of articles of the kind with which we are herein concerned produces a special grain boundary fraction no greater than 10 to 15%. The method of the present invention allows this to be improved significantly more than 20%. Enhanced resistance to intergranular corrosion and cracking results when the special grain boundary fraction goes above 30% and typically 40% to 50%.

The treatment time required to achieve the desired properties varies, depending on the material, but typically ranges from 1 minute to 75 hours, and preferably from 5 minutes to 50 hours.

With a view of achieving these objects, there is provided a method for improving intergranular corrosion and cracking resistance of an article fabricated of an austenitic Ni—Fe—Cr alloy by subjecting the alloy to at least one cycle comprising the steps of:

(i) working the surface region of the article to a depth in the range of from 0.01 mm to about 0.5 mm; and (ii) annealing the article at a temperature below the melting point of said alloy for a time sufficient to induce recrystallization in said surface region.

BRIEF DESCRIPTION OF THE DRAWINGS

Preferred embodiments of the invention are described in detail below, with reference to the drawings. The three figures are comparative cross-sectional optical micrographs of an austenitic alloy, in which:

FIG. 1(*b*) is a sample of the same Alloy 625 material but subsequent to treatment by a single cycle of surface deformation (shot peening) and recrystallization, according to the present invention; and FIG. 1(*c*) is an optical micrograph for the same alloy, which has been treated according to two cycles of the process according to the present invention.

PREFERRED EMBODIMENTS OF THE INVENTION

As is known by those skilled in the metallurgical art, cold working involves mechanical deformation of an article at a low enough temperature that dislocations are retained, leading to a structure of non-recrystallized, deformed grains. Hot working, on the other hand, results in an article having primarily recrystallized grains.

This invention relies on working the surface layer of the article, followed by an annealing treatment, which results in recrystallization of the deformed region. Shot peening is a non-conventional method of cold-working in which compressive stresses are induced in the exposed surface layers of metallic parts by impingement of a steam of shot, directed at the surface at high velocities under controlled conditions. When shot in a high-intensity stream contacts the test article surface, they produce light, rounded depressions in the surface, causing a plastic flow to extend up to 0.5 mm (0.02") below the surface. The metal beneath this layer remains unaffected. The penetration depth of the peening into the exposed surface of the article can be controlled by the hardness, weight and size of the shot and the impact velocity.

In carrying out the method of the invention, working is typically carried out below or near room temperature, e.g. between −20° C. and 45° C. We have found that the deformation treatment can also be successfully applied at higher temperatures, e.g. from about 40° C. up to a temperature of about 50% of the melting point of the article as expressed in degrees Kelvin (50% of $T_m$° K.), and preferably below 25% of $T_m$° K. In any event, the maximum deformation temperature must be below the recrystallization temperature of the alloy being treated.

Heat-treatment of the austenitic Ni—Fe—Cr article, following peening, is carried out at temperatures and times sufficient to allow complete recrystallization to occur, and which are sufficient to ensure that chromium carbides remain dissolved and that elemental chromium and carbon are retained in solid solution. We have found that suitable annealing temperatures fall in the range between 50% of $T_m$° K. and up to but less than $T_m$° K. (0.5 to <1.0 $T_m$° K.), typically between 0.6 and 0.99 $T_m$° K. and preferably between 0.7 and 0.95 $T_m$° K.

The peening and heat treatment steps can optionally be repeated a number of times to achieve optimum homogeneity in near-surface microstructure.

Also, a final lower intensity surface deformation may be applied following heat treatment in order to impart compressive stresses in the near surface of the treated article. In the case of precipitation hardenable austenitic Ni—Fe—Cr alloys, the final recrystallization treatment or reduced intensity peening treatment may be followed by an ageing heat treatment to effect the precipitation of strengthening phases.

EXAMPLE

Figure 1A:
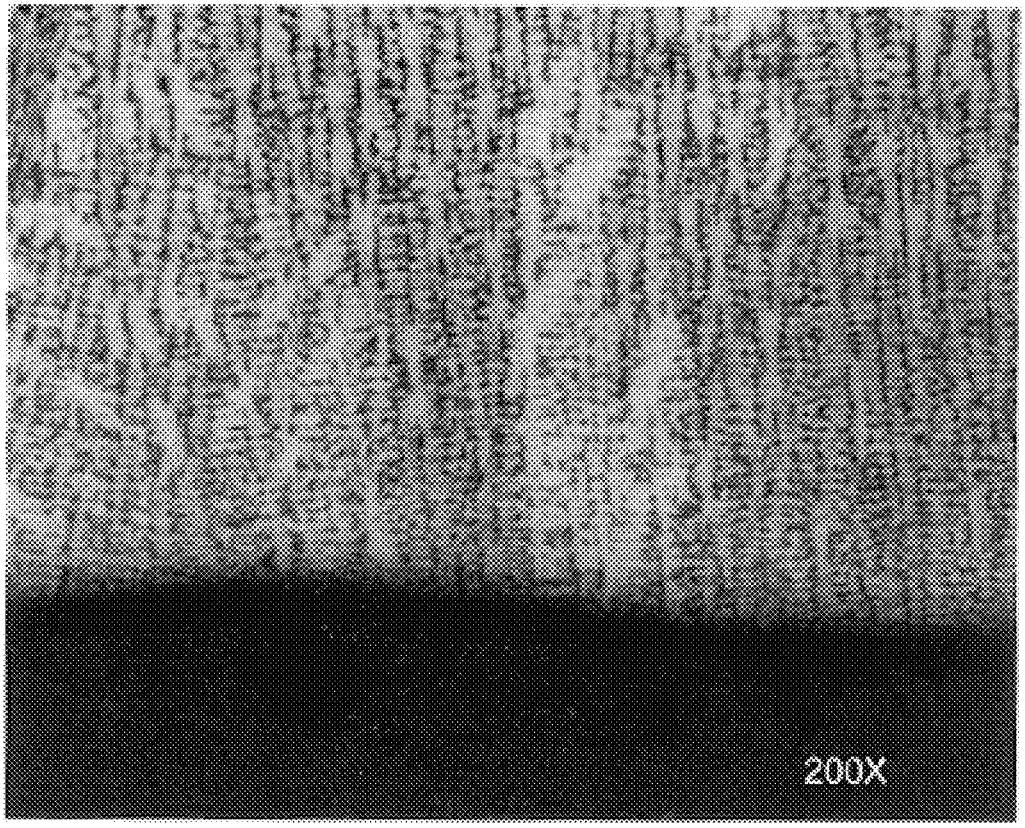
FIG. 1(*a*) is a micrograph of as-received Alloy 625.
Figure 1B:
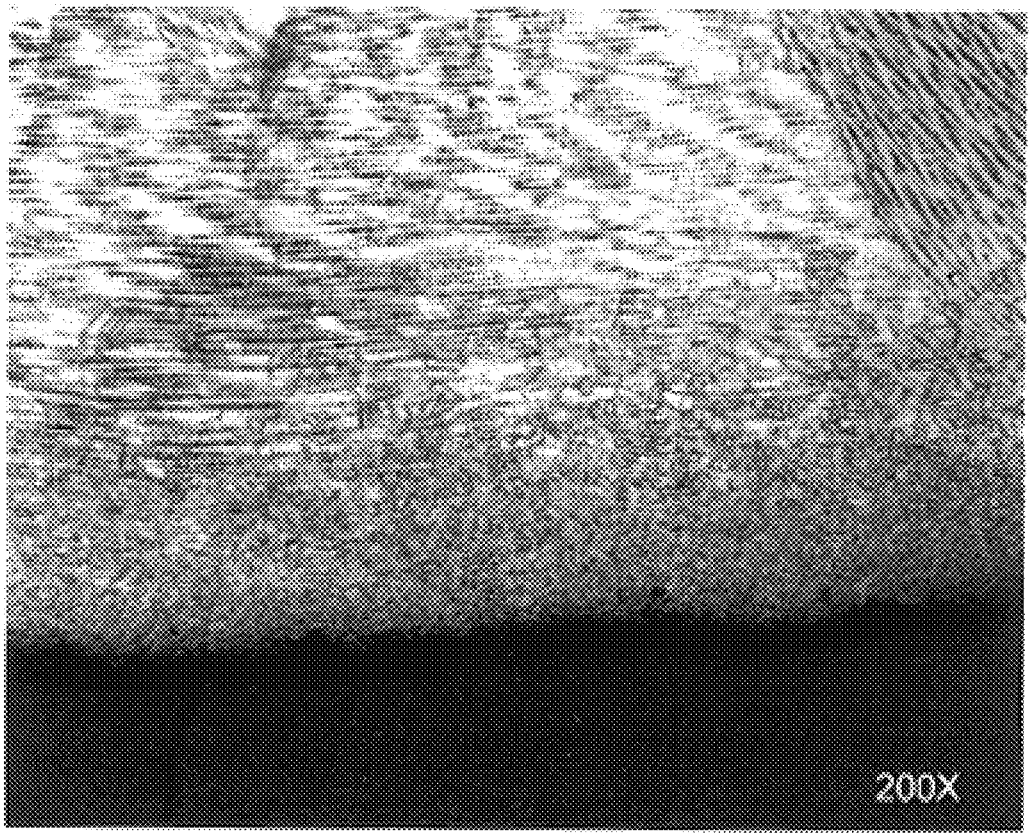
Figure 1C:
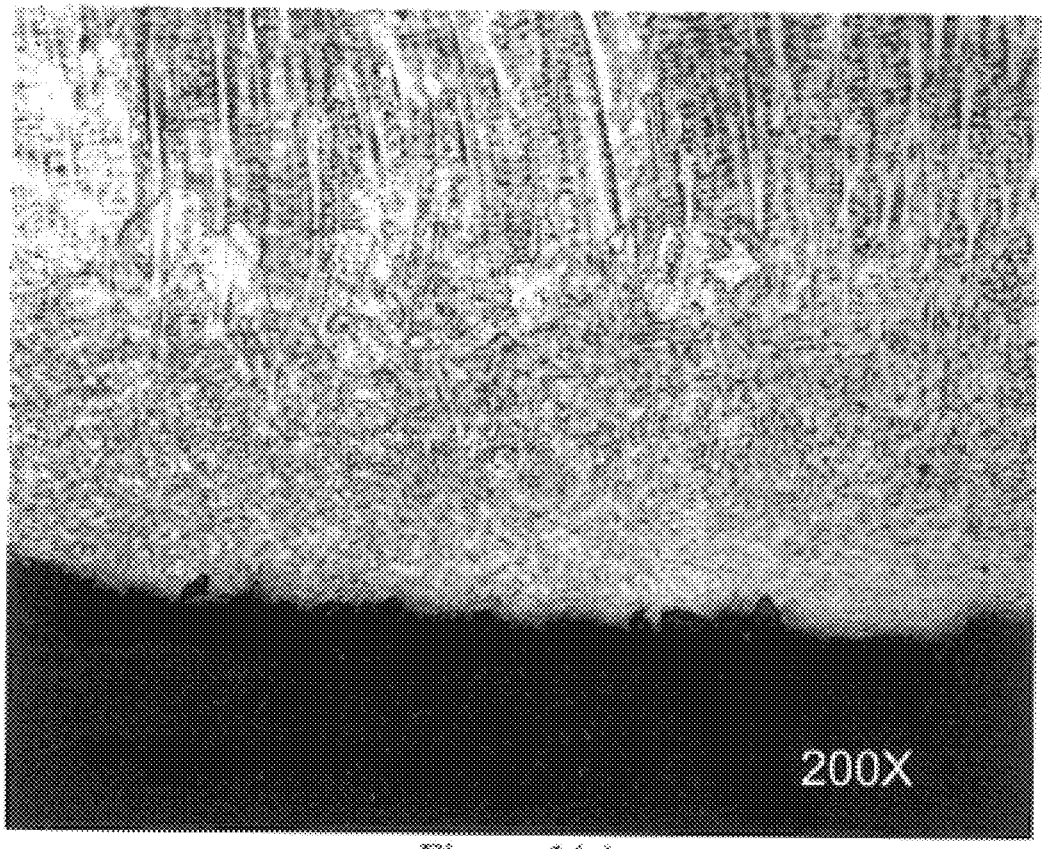

A section of austenitic weld overlay Alloy 625 (chemical composition: 61.0% Ni, 21.4% Cr, 8.2% Mo and 9.4% Fe) was obtained in the as-cast condition. Samples of the material were treated according to the preferred embodiments of this invention, whereby exposed surfaces were shot peened according to the conditions outlined in Table 1. Following each peening cycle, the samples were recrystallized at a temperature of 1000° C. (1832° F.) for 5 minutes and air-cooled. FIG. 1 shows cross-sectional optical micrographs of (a) the as-received material (F), and (b), (c) material treated by the preferred embodiments of this invention, in one and two cycles (G-1, G-2), respectively. As noted in these micrographs, the treated materials display a recrystallized surface layer extending approximately 0.127 mm (0.005 in) into the specimens. Table 2 summarizes the final microstructural characteristics obtained by applying the method of the present invention.

Treated samples and the as-received materials were subsequently subjected to a 'sensitization' heat treatment which simulates a manufacturing stress relief protocol; this treatment was applied as follows: samples were heated to a target temperature of 1650° F. (899° C.) at a heating rate of 400° F. (204° C.) per hour from room temperature; the samples were held at 1650° F. (899° C.) for 20 minutes, and subsequently furnace cooled to a temperature of 600° F. (315° C.), and then air cooled to room temperature.

All samples were subsequently corrosion tested as per ASTM G28A to evaluate resistance to intergranular corrosion arising from sensitization. The test involves 120-hour exposure in boiling ferric sulfate—50% aqueous sulfuric acid. Replicated samples of approximately 0.0615 in×0.5 in.×2 in. were accurately dimensioned to determine exposed surface area and weighed to 1 mg accuracy prior to, and following exposure in order to establish mass loss, and corrosion rate in units of mils per year.

Table 2 summarizes the measured corrosion performance. As-received and sensitized material (F), not treated according to the preferred embodiments of this invention display a corrosion rate of 393 mils per year. Material treated by the preferred embodiments of this invention and subsequently sensitized displays a marked reduction in sensitization and improvement in corrosion resistance with G-1 and G-2 specimens displaying similar average corrosion rates of 40 and 41 mils per year respectively.

TABLE 1

Details of applied shot peening parameters

| Shot Peening | Peening Time | Hardened Steel Shot Size | Air Pressure (psi) |
|---|---|---|---|
| One Cycle | 7 minutes | 0.028 in. | 80 |
| Two Cycles | (1) 7 minutes | 0.028 in. | 80 |
| | (2) 5 minutes | 0.028 in. | 80 |

TABLE 2

Summary of the microstructural characteristics

| Sample | Process conditions | Fraction of Special Grain Boundaries (%) | Grain Size (μm) | Average Corrosion Rate (mils/year) |
|---|---|---|---|---|
| F | As Received + Sensitization Treatment | ≈15 | >100 | 393 |
| G-1 | Single cycle + Sensitization Treatment | ≈50 | ≈3 | 40 |
| G-2 | Two cycles + Sensitization Treatment | ≈58 | ≈5 | 41 |

By using the process of the invention, a wide variety of articles may, without bulk deformation, be treated to increase significantly their resistance to corrosion.

We claim:

1. A method for improving intergranular corrosion and cracking resistance of an article fabricated from an austenitic Ni—Fe—Cr alloy by subjecting the article to at least one cycle comprising the steps of:

(i) working only the near surface region of the article to a depth in the range of from 0.01 mm to 0.5 mm at a temperature between −20° C. and 0.5 $T_m$° K. and less than the recrystallization temperature of the alloy, so as to leave the material composing the article below said depth substantially unaffected; and (ii) annealing the article at a temperature between 0.6 and 0.99 $T_m$° K. of the alloy of said article for a time of from 1 minute to 75 hours, sufficient to induce recrystallization in said near surface region and increase the concentration of special grain boundaries in said near surface region.

2. A method according to claim 1, wherein the maximum temperature of working is about 0.25 $T_m$° K.

3. A method according to claim 1, wherein the annealing temperature is between 0.7 and 0.95 $T_m$° K.

4. A method according to claim 1, wherein said working comprises shot peening of the surface of the article.

5. A method according to claim 1, wherein said working comprises laser peening of the surface of the snide.

6. A method according to claim 1, wherein said working comprises hammer peening of the surface of the article.

7. A method according to claim 1, wherein the annealing time is between 5 minutes and 50 hours.

8. A method according to claim 1, wherein following completion of the final cycle of said steps (I) and (ii), the article is subjected to surface work of an intensity less than that applied in step (I).

9. A method according to claim 1, wherein following completion of the final cycle of said steps (i) and (ii), the article is subjected to ageing heat treatment to precipitate strengthening phases.

10. A method according to claim 8, wherein following said surface work of less intensity, the article is subjected to an ageing heat treatment to precipitate strengthening phases.

11. A method according to claim 1, in which the special grain boundary fraction within said near surface region is increased to at least 20%.

12. A method according to claim 11, wherein said special grain boundary fraction is at least 30%.

13. A method according to claim 12, wherein said special grain boundary fraction is at least 40%.

14. A method according to claim 1, wherein the article is a nuclear reactor core head penetration.

15. A method according to claim 1, wherein the article is a recovery boiler panel.

16. A method according to claim 1, wherein successive treatment steps (i) and (ii) are applied only to a localized surface region of said article.

17. A method according to claim 16, wherein said localized region is a weld.

18. A method according to claim 16, wherein said localized region is the heat-affected zone of a weld.

19. A method according to claim 17, or claim 18, wherein said weld is a closure weld on a nuclear waste storage container.

* * * * *